US005853092A

United States Patent [19]

Goodman et al.

[11] Patent Number: 5,853,092

[45] Date of Patent: Dec. 29, 1998

[54] SELF-ADAPTING TOOL RACK

[76] Inventors: Gregory L. Goodman, 303 E. 37th St., Apt. 6B, New York, N.Y. 10016; Jeffrey O. Milman, 315 W. 70th St., Apt. 5F, New York, N.Y. 10023

[21] Appl. No.: 919,846

[22] Filed: Aug. 28, 1997

[51] Int. Cl.[6] ..... A47F 5/00

[52] U.S. Cl. ..... 211/70.6; 211/87.01; 211/106.01

[58] Field of Search ..... 211/70.6, 87.01, 211/89.01, 66, 106.01, 104, 99

[56] References Cited

U.S. PATENT DOCUMENTS

| | | | |
|---|---|---|---|
| 309,621 | 12/1884 | Herrick et al. . | |
| 1,376,546 | 5/1921 | Jeep . | |
| 3,310,271 | 3/1967 | King . | |
| 4,036,366 | 7/1977 | Dixon et al. | 211/70.6 X |
| 4,221,354 | 9/1980 | Kempkers . | |
| 4,852,930 | 8/1989 | Agee . | |
| 5,322,256 | 6/1994 | Kanwischer . | |
| 5,762,211 | 6/1998 | Ensign | 211/70.6 |

*Primary Examiner*—Robert W. Gibson, Jr.

[57] ABSTRACT

A rack for conveniently storing or displaying objects such as shop and garden tools, kitchen implements, office supplies and the like, having an array of individually retractable hooks. The hooks rest in an extended, or ready position. When an object is pressed against the rack, any hooks impacted by the object are caused to be moved into a retracted, or out of the way position. Any untouched hooks remain in an extended position, ready to engage and support the object at key points. Retracted hooks automatically return to an extended position when released by the removal of the object from the rack. In this manner, the rack automatically adapts to the shapes and sizes of different objects; thereby permitting objects to be quickly and easily hung on the rack, arranged on the rack in various groupings, and rearranged at any time, all without the need to manually adjust the position of the hooks.

20 Claims, 2 Drawing Sheets

Fig. 2
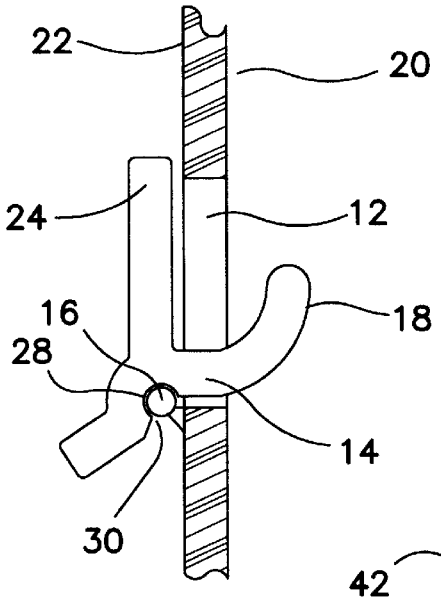
Fig. 3
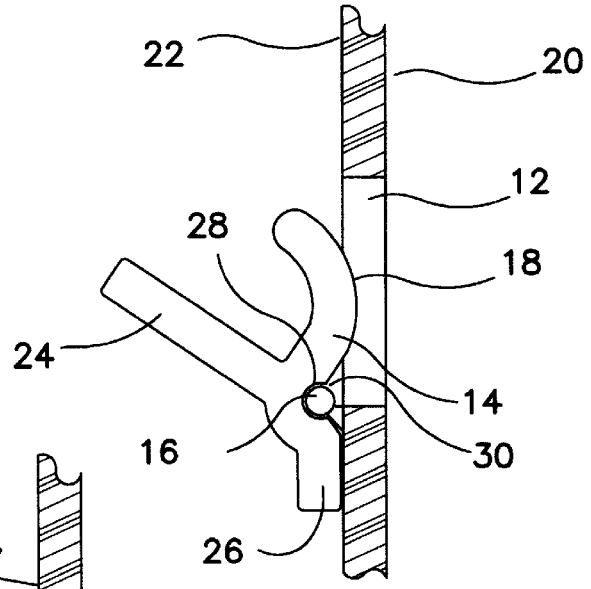
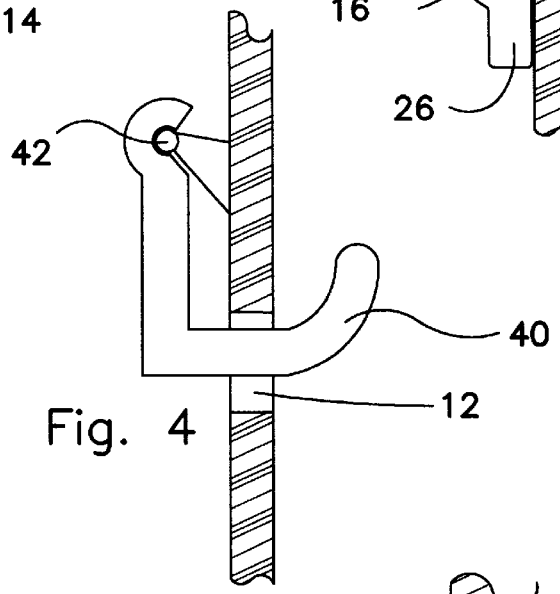
Fig. 4
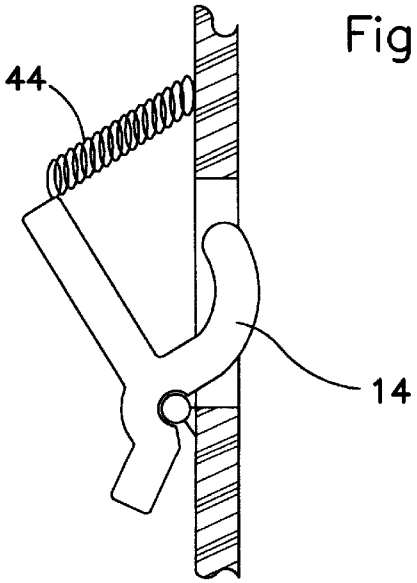
Fig. 5
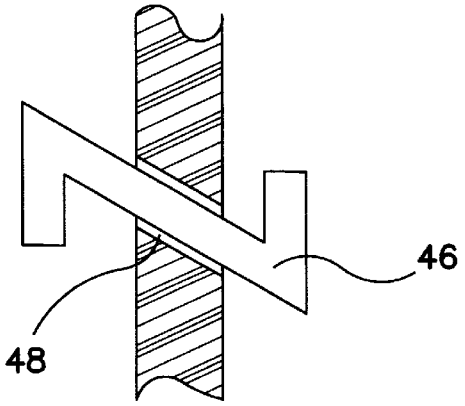
Fig. 6

SELF-ADAPTING TOOL RACK

FIELD OF THE INVENTION:

This invention relates to utility racks for storing or displaying tools, and more particularly, to pegboards and other racks with configurable hooks or pegs.

BACKGROUND OF THE INVENTION:

Businesses and homes frequently rely on pegboards and other types of utility racks with configurable hooks or pegs to store or display objects such as shop and garden tools, kitchen implements, office supplies, and the like. Such racks are popular because they permit the user to customize the arrangement of hooks or pegs to accommodate the shapes and sizes of different objects. More specifically, the hooks or pegs are manually placed on the racks in selected positions to support objects at key points, and omitted from positions where they would interfere with the hanging of those objects. Racks with configurable hooks or pegs also permit objects to be grouped closely together vertically and horizontally, thereby allowing many more objects to be hung in a given space than would be possible with racks having fixed-position hooks or pegs. Examples include U.S. Pat. No. 3,310,271 to King (1967) which describes a pegboard with elongated slots for securely mounting hooks, and U.S. Pat. No. 4,852,930 to Agee (1989) which describes a decorative tool hanging device with removable stud type tool supports.

One common fault with pegboards and other types of racks with configurable hooks or pegs is that they are time consuming initially to set up, and even more time consuming to rearrange after the hooks or pegs have been placed into a particular configuration. Moreover, when the hooks or pegs are in position and a particular arrangement of objects has been established, any objects that are removed and subsequently returned to the pegboard or rack need to be carefully re-hung in precisely the same locations. An object placed in the wrong location may not hang securely since it would hang from hooks or pegs configured for a different object, and may encounter other hooks or pegs that block the object from hanging close against the face of the rack. Furthermore, one improperly re-hung object would interfere with the subsequent re-hanging of another object meant for that space. This can be particularly problematic when several objects have been removed from the pegboard or rack at the same time, which creates the challenge of figuring out where each object was originally hung. To facilitate proper placement when re-hanging objects, users often resort to drawing outlines of the objects on the face of the pegboard or rack as a reminder of their respective positions; thereby creating the additional problem of having to erase the outlines should the user later decide to rearrange the objects.

For these reasons, pegboards and other racks with configurable hooks or pegs are not only time consuming to set up and rearrange, but are inherently inflexible once the hook or peg positions have been established. This is due, in part, to the fact that the hooks or pegs are designed to remain stationary, protruding from the pegboard or rack, after they have been placed on the pegboard or rack. Other types of hooks are known which are retractable. Examples include: U.S. Pat. No. 1,376,546 to Jeep (1921) which describes a merchandise sales tag hook that retracts when in use to retain the tag more securely and to avoid its being jostled by passing shoppers; U.S. Pat. No. 4,221,354 to Kempkers (1980) which describes a hook for hanging articles of clothing in a vehicle, which hook may be retracted for appearance and safety reasons when not in use; and, U.S. Pat. No. 5,322,256 to Kanwischer (1994) which describes a storage device for holding tools between a pair of jaws that may also be retracted when not in use. All such retractable hooks noted above, however, must be manually adjusted to either an extended or retracted position. If a plurality of such devices were used to make up a storage rack, the need to manually adjust each hook would substantially undermine the convenience of using such a rack. Furthermore, the Kanwischer device includes numerous parts, which would significantly contribute to the cost of manufacturing and assembling such a rack.

Freely movable hooks are also known, and have existed for many years. One example is U.S. Pat. No. 309,621 to Herrick & McManus (1884) which describes a hook with a ball joint seated in a socket. However, this hook, and other hooks of a similar nature, are designed for multidirectional movement and are not designed to automatically return to a fixed, ready position when not in use. In other words, when an object is lifted off of the hook, the hook may remain pointed in any of several directions; thus rendering it unsuitable for a pegboard-style rack.

Hence, the devices disclosed in the King, Agee, Jeep, Kempkers, Kanwischer, and Herrick & McManus patents, and similar devices known to exist in the marketplace, all have the following deficiencies:

(a) None of the devices provides a means of customizing the configuration of hooks or pegs on a tool rack to accommodate a variety of different tools without the need to manually establish the initial positions of the hooks or pegs;

(b) None of the devices provides a means of quickly and easily re-configuring hooks or pegs on a tool rack to accommodate changes in the placement of tools without the need to manually re-establish the positions of the hooks or pegs; and, (c) None of the devices comprises a tool rack with configurable hooks or pegs that requires no manual intervention to set up or rearrange, that is simple and inexpensive to manufacture and assemble, and where the user does not need to worry about re-hanging tools in the same position to ensure that they will hang correctly.

SUMMARY OF THE INVENTION

The present invention provides a tool rack having built-in retractable hooks that securely hold tools of different shapes and sizes in any desired arrangement without the need to manually establish the initial positions of the hooks, or to manually re-position the hooks to accommodate changes in the placement of tools. This capability eliminates several problems with the prior art. That is, a tool may be placed on any open space on the rack at any time, tools may be grouped closely together on the rack, and any tool on the rack may be removed and securely re-hung in a different location, all without manually adjusting the hooks. Moreover, the present invention can be manufactured and assembled simply and inexpensively.

The features and aspects of the present invention noted above are accomplished by providing hooks pivotally mounted on a vertical panel such that the hooks may be moved from an extended, or ready position, to a retracted, or out of the way position simply by pressing a tool against the front of the panel. Hooks that are not touched by the tool when it is pressed against the panel remain in an extended position such that the tool may be lowered onto some of the hooks and thereafter held in position by the force of gravity. When the tool is lifted off of the rack, the retracted hooks automatically return to an extended position.

More particularly, the present self-adapting tool rack comprises a vertical panel perforated by a plurality of evenly spaced vertical slots in which are situated a like number of hooks rotatably mounted on pivots which are located in the back of the panel near the lower end of the slots. The hooks curve upwardly in the direction of the front of the panel, and extend through the slots from the back of the panel to the front of the panel. The upwardly curved portions of the hooks protrude from the front surface of the panel a sufficient distance to permit objects to be placed thereupon. The slots are of a size and shape relative to the hooks such that the hooks may slide through them freely, and such that the hooks are able to be pushed toward the back of the panel to a point where the forward-most edges of the hooks are flush with the front surface of the panel. This feature ensures that when a tool is pressed against the front of the panel, any hooks that might otherwise interfere with that tool hanging close against the front surface of the panel are caused to move into a retracted, or out of the way position.

The main body of each hook is situated above each pivot. Further, the weight of each hook is displaced on its respective pivot such that the force of gravity causes the upwardly curved portion of each hook to naturally rotate in the direction of the front of the panel; i.e., to protrude from the front surface of the panel. A catch is included on each hook to limit its forward motion; and a second catch may be included to limit its rearward motion when being pushed into a retracted position.

The self-adapting tool rack of this invention permits inexpensive manufacturing since the hooks are of a uniform shape and size. Moreover, the portion of each hook that permits the hook to rotate on the pivot may be formed as a rounded recess with one open side, thereby permitting the hooks to be easily and securely snapped into place during assembly.

The self-adapting tool rack of this invention may include one or more wall mounting tabs or other structures on the rear side or outside edges of the rack to facilitate hanging the rack on a wall, and/or may include a base fixture to permit the rack to stand on a table or counter top.

In one variation of the invention, the pivots are located at or near the top ends of the slots, and the hooks hang downward and are able to swing like pendulums. In another variation of the invention, the hooks slide in and out of a sloping channel. Alternate and equivalent structures for the pivot and sloping channel may be substituted.

In another variation of the invention, a spring is included on each hook as an alternative to using the force of gravity to restore the hooks to the extended position when not being pressed against the rack by a tool. Alternative and equivalent structures for the spring may be substituted, including various elastic materials and magnets.

With the foregoing and other objects, advantages, and features of the invention that will become hereinafter apparent, the nature of the invention may be more clearly understood by reference to the following detailed description of the invention, the appended claims, and to the several views illustrated in the drawings.

BRIEF DESCRIPTION OF THE DRAWING FIGURES

FIG. 2 is an enlarged fragmentary partially sectional side view of the device taken along line 2—2 of . 1 showing one hook in an extended position mounted on a pivot;

FIG. 3 is an enlarged fragmentary partially sectional side view of the device taken along line 2—2 of FIG. 1 showing one hook in a retracted position mounted on a pivot;

FIG 4 is an enlarged fragmentary side view similar to FIG. 2, but illustrating an alternate embodiment of this invention wherein the hook is suspended from a pivot;

FIG. 5 is an enlarged fragmentary side view similar to FIG. 3, but illustrating an alternate embodiment invention wherein a spring is included;

FIG. 6 is an enlarged fragmentary partially sectional side view of an alternate embodiment of this invention showing an angular hook in a sloping channel.

Reference Numerals in Drawing Figures

Figure 1:
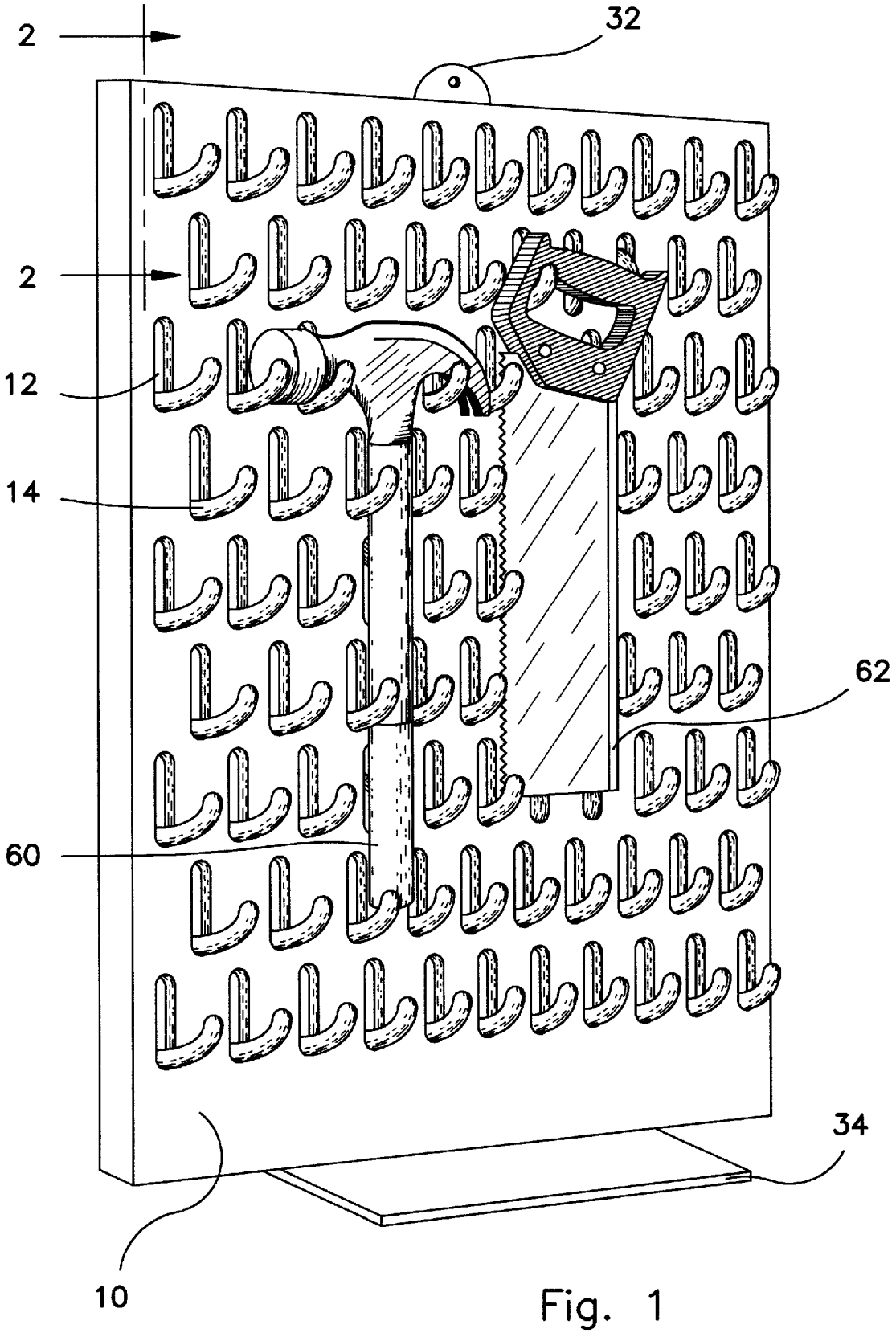
FIG. 1 is a perspective view of a self-adapting tool rack according to the present invention showing a hammer and saw hung on the rack for illustration.

| | |
|---|---|
| 10 panel | 30 recess opening |
| 12 slot | 32 wall mounting tab |
| 14 hook | 34 support base |
| 16 pivot | 40 hanging hook |
| 18 curved section | 42 suspending pivot |
| 20 panel front surface | 44 spring |
| 22 panel rear side | 46 angular hook |
| 24 upper catch | 48 sloping channel |
| 26 lower catch | 60 hammer |
| 28 rounded recess | 62 saw |

DETAILED DESCRIPTION OF THE INVENTION

Referring now in detail to the drawings wherein like parts are designated by like reference numerals throughout, FIG. 1 illustrates a self-adapting tool rack according to the present invention viewed from the front and showing a hammer 60 and saw 62 hanging on the rack as an example of the use of the device. The present embodiment of the invention is described in terms of a vertical panel 10 perforated by a plurality of evenly spaced vertical slots 12 in which are situated a like number of hooks 14.

As shown in FIGS. 2 and 3, each hook 14 is rotatably mounted on a pivot 16 located on a panel rear side 22 near the lower end of each slot 12. Hooks 14 each have an upwardly curved section 18 which extends through slots 12 from panel rear side 22 in the direction of a panel front surface 20. Upwardly curved section 18 of each hook 14 protrudes from panel front surface 20 a sufficient distance to permit tools to be placed upon hooks 14 for storage or display.

Slots 12 are of a size and shape relative to hooks 14 such that hooks 14 may slide freely, and such that hooks 14 are able to be pushed toward panel rear side 22, i.e., to rotate on pivots 16, to an extent where the forward-most edges of upwardly curved sections 18 of hooks 14 become flush with panel front surface 20.

In a preferred embodiment of the present invention, the main body of each hook 14 is situated above each pivot 16. Further, the weight of each hook 14 is displaced on its respective pivot 16 such that the force of gravity causes hook 14 to naturally rotate in the direction of panel front surface 20. In this manner, upwardly curved section 18 of each hook 14 is caused to protrude from panel front surface 20. FIG. 2 illustrates hook 14 in such a frontally rotated, i.e., extended, position. An upper catch 24 protrudes from each hook 14, which upper catch 24 limits the movement of hook 14 by coming into contact with panel rear side 22 after hook 14 has rotated a certain distance.

FIG. 3 illustrates hook 14 in a retracted position. A lower catch 26 protrudes from hook 14 to limit its rearward motion when hook 14 is rotated into a retracted position.

As shown in FIGS. 2 and 3, hook 14 includes a rounded recess 28 encircling and slightly larger than pivot 16, which permits hook 14 to rotate. Such rounded recess 28 further includes a recess opening 30 which is slightly smaller in width than the diameter of pivot 16, and which permits hook 14 to be snapped over pivot 16 during assembly and thereafter remain rotatably attached to pivot 16.

In this preferred embodiment, panel 10, as shown in FIG. 1, is planar and includes panel front surface 20. Alternate shapes and equivalent structures may be substituted; including structures that include curves and other variations in the surface, and structures that employ other means of providing a surface or surfaces against which objects may come to rest when hung on hooks 14. Alternate shapes and equivalent structures may also be substituted for hooks 14 which have curved sections 18 (as shown in FIGS. 2, 3); including hooks with angular bends, and straight peg-like shafts. Alternatively shaped perforations in panel 10 other than slots 12 may also When a tool to be stored or displayed using the present invention is pressed against panel front surface 20, the tool will come into contact with certain hooks 14 and not with others. Any hooks 14 that are not touched by the object remain in an extended position, while hooks 14 that are impacted by the tool rotate into a retracted, or out of the way position. This feature ensures that any hooks 14 that might otherwise interfere with the tool hanging close against panel front surface 20 are caused to move out of the way, while other surrounding hooks 14 remain in an extended, or ready position. When the tool is subsequently lowered, it will come into contact with surrounding hooks 14 at key points based on the shape and size of the tool. The tool may then be left to hang upon and be supported by such hooks 14; remaining in position by force of gravity. If the tool is subsequently lifted off of the rack, any hooks 14 that had been caused to rotate into the retracted position by having been pressed against by the tool automatically rotate to an extended position; i.e., ready to accommodate the same tool, or another tool having a different shape and size.

The self-adapting tool rack of this invention permits inexpensive manufacturing since hooks 14 are of a uniform shape and size. Such uniformity simplifies production tooling; and renders the parts interchangeable, thereby simplifying assembly of the device.

Referring again to FIG. 1, one or more wall mounting tabs 32 may be included to permit the invention to be easily hung on a wall. Alternatively, a support base 34 may be included to permit the invention to stand on a table or counter top. Alternate and equivalent structures for wall mounting tab 32 and support base 34 may be substituted.

Turning now to FIG. 4 which is comparable to the views in FIGS. 2 and 3, but illustrates an alternate embodiment of the tool rack wherein a hanging hook 40 depends from a suspending pivot 42 located at or above the top end of slot 12. In this embodiment, hanging hook 40 swings like a pendulum.

FIG. 5 is similar to the view in FIG. 3, but illustrates an alternate embodiment of the invention wherein a spring 44 is included as an alternative to using the force of gravity to restore hook 14 from a retracted position to an extended position. Alternate and equivalent structures may be substituted for spring 44, including magnets.

FIG. 6 illustrates an alternate embodiment wherein an angular hook 46 is disposed in a sloping channel 48 such that when a tool is pressed against angular hook 46, angular hook 46 would slide at an upward angle through sloping channel 48 to a retracted position; and, when released by the removal of the tool, would slide in the reverse direction to the extended position by the force of gravity. Alternate and equivalent structures for angular hook 46 may be substituted; alternative forces to the force of gravity may be substituted in this embodiment; and, in the case of alternative forces, a horizontal channel may be substituted.

In general, all of the parts of the present invention excluding spring 44 may be made of molded plastic, metal, or wood, or other rigid and semi-rigid materials. Spring 44 may be made of metal or plastic, or other materials that may be used to achieve a spring action.

Although certain presently preferred embodiments of the invention have been described herein, it will be apparent to those skilled in the art to which the invention pertains that variations and modifications of the described embodiments may be made without departing from the spirit and scope of the invention. Accordingly, it is intended that the invention be limited only to the extent required by the appended claims and applicable rules of law.

What is claimed is:

1. A self-adapting rack for holding tools comprising a plurality of individually retractable hooks made of a rigid material and of a sufficient size to engage a tool, said hooks arrayed in a vertically disposed grid-like pattern on a support member and able to protrude from the periphery of said support member so as to permit a tool to be placed thereupon and held by the force of gravity, and a force means for continuously urging said hooks to protrude from said support member unless individually or in combination acted upon by an opposing force equal to or greater than that of a tool being manually pressed against one or more of said hooks, whereby said hooks may be selectively caused to retract according to the shape and size of a tool and will be caused to once again protrude from said support member when no longer engaged by said tool.

2. The self-adapting rack according to claim 1, wherein said support member includes a sheet of vertically disposed rigid material having a smooth or nearly smooth front surface and a plurality of perforations equal in number to said hooks, and said hooks are disposed in said perforations and protrude from said front surface, whereby a tool hung on said hooks may come to rest against said sheet of rigid material.

3. The self-adapting rack according to claim 1, wherein said force means is the force of gravity.

4. The self-adapting rack according to claim 1, wherein said force means is a plurality of springs communicating with said support member and said hooks.

5. The self-adapting rack according to claim 1, wherein said force means is a plurality of magnets communicating with said support member and said hooks.

6. The self-adapting rack according to claim 3, including pivots operatively coupled with said hooks, whereby said hooks may be caused to rotate.

7. The self-adapting rack according to claim 3, wherein said support member includes a plurality of sloping channels and said hooks are slidably mounted in said channels.

8. The self-adapting rack according to claim 6, wherein said pivots are rounded, said hooks have rounded recesses slightly larger in diameter than said pivots, and said rounded recesses have an open side slightly smaller in width than the diameter of said pivots, whereby said tool suspension members may be snapped onto said pivots during assembly.

9. A self-adapting rack for holding tools comprising:

(a) a plurality of tool suspension members of uniform shape and size made of a rigid material, said members each having an elongated portion of sufficient size to engage a tool;

(b) support means for holding said tool suspension members proximate to one another at spaced vertical and horizontal intervals, said support means having a substantially planar front edge, and said elongated portions protrude from and point in a direction substantially perpendicular to said front edge, whereby said tool suspension members may hold a tool by force of gravity;

(c) retraction means so as to permit each of said tool suspension members to be independently moved to a retracted position substantially flush with said support means front edge by an external force equal to or greater than that of a tool being manually pressed against one or more of said tool suspension members in a direction toward said support means front edge, whereby said tool suspension members may be selectively caused to retract according to the size and shape of said tool;

(d) force means for continuously urging said tool suspension members to protrude from said support means front edge, said force means being able to be overcome by an external force equal to or greater than that of a tool being manually pressed against one or more of said tool suspension members or a tool being held by force of gravity upon any other of said tool suspension members, whereby said tool suspension members may be generally maintained in protruding relation with said support means front edge when not being pressed against by a tool, and any of said tool suspension members in said retracted position will be caused to move so as to again protrude from said support means front edge when no longer pressed against by said external force.

10. The self-adapting rack according to claim 9, wherein said tool suspension members are hooks.

11. The self-adapting rack according to claim 9, wherein said tool suspension members are arranged in a plurality of uniform horizontal rows.

12. The self-adapting rack according to claim 9, wherein said tool suspension members are arranged in a plurality of staggered horizontal rows.

13. The self-adapting rack according to claim 9, wherein said support means front edge is a sheet of vertically disposed rigid material having a smooth or nearly smooth front surface and a plurality of perforations equal in number to said tool suspension members, and said tool suspension members are disposed in said perforations, whereby a tool hung on said tool suspension members may come to rest against said sheet of rigid material.

14. The self-adapting rack according to claim 9, wherein said retraction means is a plurality of pivots and said tool suspension members are operatively coupled with said pivots, whereby said tool suspension members may be caused to rotate.

15. The self-adapting rack according to claim 9, wherein said retraction means is a plurality of channels in which said tool suspension members are slidably mounted.

16. The self-adapting rack according to claim 9, wherein said force means is a plurality of springs communicating with said support means and said tool suspension members.

17. The self-adapting rack according to claim 9, wherein said force means is a plurality of magnets communicating with said support means and said tool suspension members.

18. The self-adapting rack according to claim 9, wherein said force means is the force of gravity.

19. The self-adapting rack according to claim 9, wherein said support means front edge has one or more curves.

20. The self-adapting rack according to claim 14, wherein said pivots are rounded, said tool suspension members have rounded recesses slightly larger in diameter than said pivots, and said rounded recesses have an open side slightly smaller in width than the diameter of said pivots, whereby said tool suspension members may be snapped onto said pivots during assembly.

* * * * *